US009942669B2

(12) United States Patent
Nikles et al.

(10) Patent No.: US 9,942,669 B2
(45) Date of Patent: Apr. 10, 2018

(54) HEARING DEVICE FOR BINAURAL SUPPLY AND METHOD FOR ITS OPERATION

(71) Applicant: SIVANTOS PTE. LTD., Singapore (SG)

(72) Inventors: Peter Nikles, Erlangen (DE); Simon Huettinger, Erlangen (DE); Johannes Kuhn, Nuremberg (DE)

(73) Assignee: Sivantos Pte. Ltd., Singapore (SG)

( * ) Notice: Subject to any disclaimer, the term of this patent is extended or adjusted under 35 U.S.C. 154(b) by 86 days.

(21) Appl. No.: 15/015,498

(22) Filed: Feb. 4, 2016

(65) Prior Publication Data

US 2016/0249140 A1 Aug. 25, 2016

(30) Foreign Application Priority Data

Feb. 4, 2015 (DE) ..... 10 2015 201 945

(51) Int. Cl.
*H04R 5/00* (2006.01)
*H04R 25/00* (2006.01)
*H04R 5/033* (2006.01)

(52) U.S. Cl.
CPC ..... *H04R 25/552* (2013.01); *H04R 25/30* (2013.01); *H04R 25/305* (2013.01); *H04R 25/554* (2013.01); *H04R 5/033* (2013.01); *H04R 2205/041* (2013.01); *H04R 2225/55* (2013.01); *H04R 2225/61* (2013.01); *H04R 2460/03* (2013.01)

(58) Field of Classification Search
CPC ..... H04R 25/554; H04R 2225/55; H04R 2205/041; H04R 2225/61; H04R 2460/03; H04R 25/30; H04R 25/305; H04R 5/033
See application file for complete search history.

(56) References Cited

U.S. PATENT DOCUMENTS

| | | | |
|---|---|---|---|
| 7,020,296 | B2 | 3/2006 | Niederdraenk |
| 8,145,246 | B2 | 3/2012 | Rasmussen |
| 2004/0037442 | A1 | 2/2004 | Nielsen et al. |
| 2008/0253595 | A1 | 10/2008 | Steinbuss |
| 2009/0197532 | A1 | 8/2009 | Wyper |
| 2010/0128907 | A1 | 5/2010 | Dijkstra et al. |
| 2011/0158441 | A1 | 6/2011 | Batra |
| 2012/0155670 | A1 | 6/2012 | Rutschman |

(Continued)

FOREIGN PATENT DOCUMENTS

| | | | |
|---|---|---|---|
| DE | 10048354 | A1 | 5/2002 |
| EP | 1983801 | A2 | 10/2008 |

(Continued)

*Primary Examiner* — Regina N Holder
(74) *Attorney, Agent, or Firm* — Laurence A. Greenberg; Werner H. Stemer; Ralph E. Locher

(57) ABSTRACT

A binaural hearing device has first and second hearing aids and a control device. Each hearing aid has a communication unit, an audio receiver and an earphone. The communication units are configured for reciprocal data transmission by inductive coupling. The audio receivers receive and process stereophonic audio data. The control device switches one of the hearing aids to an inactive audio reception state and the other to an active audio reception state, swaps the audio reception states of the hearing aids within an operating period based on a signal strength of the audio signal of one hearing aid at a time, and drives the hearing aid with the active audio reception state to transmit audio data to the hearing aid with the inactive audio reception state via the communication units.

18 Claims, 1 Drawing Sheet

(56) References Cited

U.S. PATENT DOCUMENTS

| | | | |
|---|---|---|---|
| 2012/0230510 | A1 | 9/2012 | Dinescu et al. |
| 2014/0169570 | A1 | 6/2014 | Kalluri et al. |
| 2014/0270191 | A1 | 9/2014 | Nikles |
| 2016/0049161 | A1 | 2/2016 | Tsujikawa et al. |

FOREIGN PATENT DOCUMENTS

| | | | |
|---|---|---|---|
| EP | 2129170 | A1 | 12/2009 |
| EP | 2744229 | A2 | 6/2014 |
| EP | 2782363 | A1 | 9/2014 |
| JP | 2004504786 | A | 2/2004 |
| JP | 2010523018 | A | 7/2010 |
| JP | 2013504937 | A | 2/2013 |
| WO | 2006122836 | A2 | 11/2006 |
| WO | 2014114818 | A2 | 7/2014 |
| WO | 201415860 | A1 | 8/2014 |
| WO | 2014184395 | A2 | 11/2014 |
| WO | 2015018456 | A1 | 2/2015 |

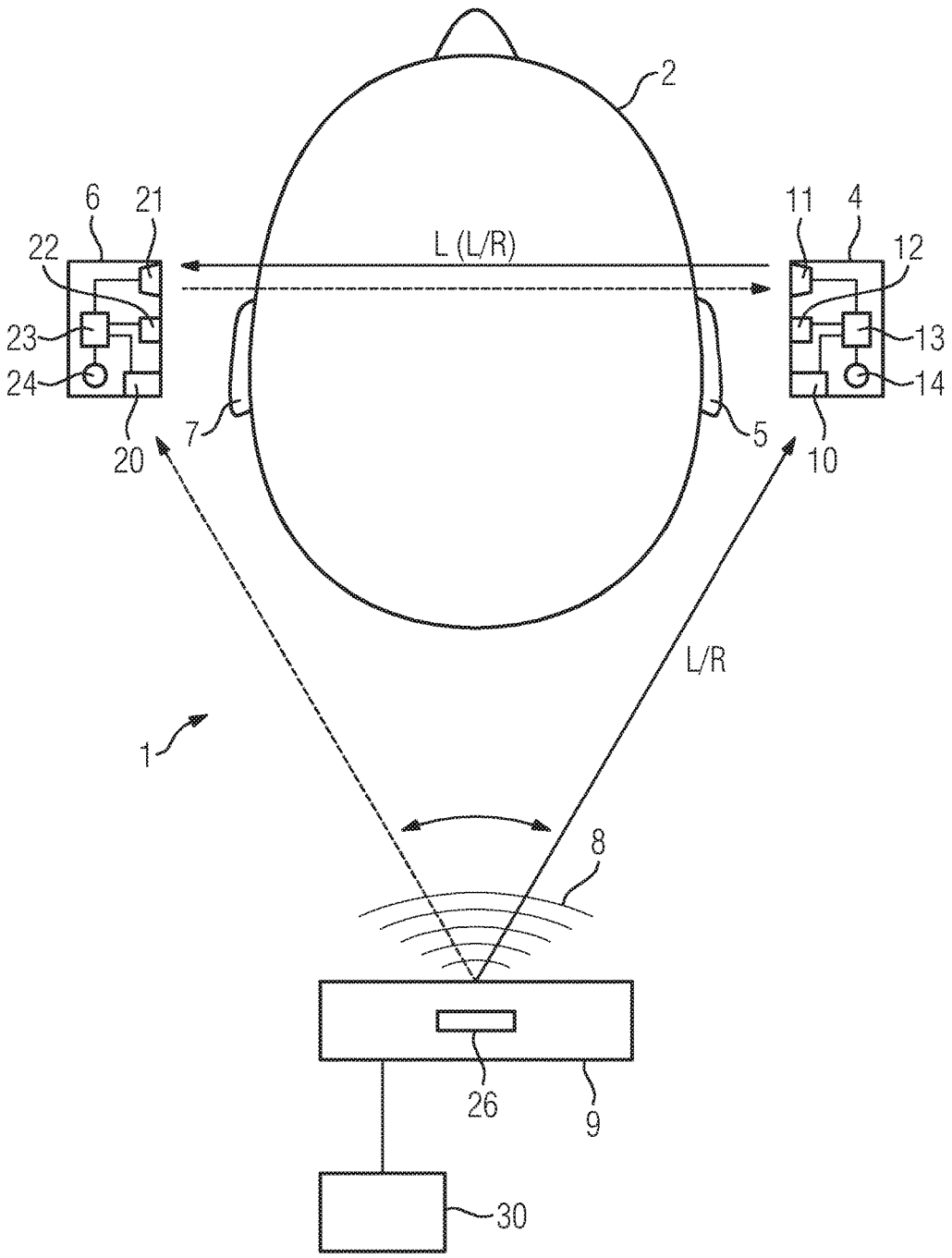
2
6
21
22
23
24
20
7
L (L/R)
11
4
12
13
14
10
5
L/R
1
8
26
9
30

HEARING DEVICE FOR BINAURAL SUPPLY AND METHOD FOR ITS OPERATION

BACKGROUND OF THE INVENTION

Field of the Invention

The invention relates to a hearing device for catering for the binaural needs of a user that has a first hearing aid for catering for the first ear, a second hearing aid for catering for the second ear and a control device for controlling the first and second hearing aids, wherein the first hearing aid comprises a first communication unit, a first audio receiver and a first earphone, wherein the second hearing aid comprises a second communication unit, a second audio receiver and a second earphone, and wherein the first communication unit and the second communication unit are designed for reciprocal data transmission by dint of inductive coupling. In addition, the invention relates to a method for operating such a hearing device. The invention is concerned with the application of inserting in particular stereophonic audio data for the user of a binaural hearing device.

A hearing device of the type cited at the outset is known from EP 2 782 363 A1, for example. This document discloses, for a hearing aid, a specific arrangement of an antenna for binaural data transmission with a high bandwidth. In addition, EP 1 983 801 A2 also discloses such a hearing device for catering for the binaural needs of a user. This document proposes adjusting one hearing aid by dint of reciprocal data interchange by using hardware information about the other hearing aid and/or audiometric data about the other ear. According to DE 100 48 354 A1, sound field characteristic values are interchanged on the signal path between the two hearing aids and used for adapting the signal processing in the hearing aids.

In addition, WO 2006/122836 A2 discloses a hearing device of the type cited at the outset. For the purpose of a bidirectional connection between the communication units of the two hearing aids by means of inductive coupling, specifically oriented antennas are cited. EP 2 129 170 B1 describes, for a hearing device of the type cited at the outset, the transmission of audio data to a battery-operated hearing aid. A unit having an audio transmitter transmits digital audio data to an intermediate communication unit. The hearing aid and the intermediate communication unit have a wireless inductive connection set up between them in at least one direction.

In the case of a hearing device that comprises particularly battery-operated hearing aids, it is fundamentally necessary to be mindful of energy efficiency in order to allow the longest possible operating time and life. This is also true of a practical application in which in particular stereophonic audio data are inserted into a binaural hearing device that comprises a first hearing aid and a second hearing aid.

BRIEF SUMMARY OF THE INVENTION

As a first object, the invention is based on providing a hearing device of the type cited at the outset for catering for the binaural needs of a user, which device allows audio data to be inserted with the greatest possible energy efficiency. As a further object, the invention is based on specifying a method for operating a hearing device for catering for the binaural needs of a user, which method has the greatest possible energy efficiency for the insertion of audio data.

The invention achieves the first cited object for a hearing device of the type cited at the outset by dint of the first audio receiver and the second audio receiver being set up for reception and processing of in particular stereophonic audio data, and by dint of the control device being set up to switch one of the two hearing aids to an inactive audio reception state and the other hearing aid to an active audio reception state, to swap the audio reception states of the hearing aids within an operating period on the basis of a parameter that characterizes a signal strength of the audio signal and that is based on one hearing aid at a time, and to actuate the hearing aid with the active audio reception state to transmit audio data to the hearing aid with the inactive audio reception state by dint of inductive coupling by means of the communication units.

The invention achieves the second cited object for a method for operating a hearing device of the type cited at the outset by dint of, in an active audio reception state of one hearing aid, the associated audio receiver receiving and performing further processing on in particular stereophonic audio data, while the other of the hearing aids is switched to an inactive audio reception state, by dint of the audio reception states of the hearing aids (4, 6) being swapped within an operating period on the basis of a parameter that characterizes a signal strength of the audio signal and that is based on one hearing aid (4, 6) at a time, and by dint of the hearing aid in the active audio reception state being used to transmit audio data to the hearing aid in the inactive audio reception state by dint of inductive coupling by means of the communication units.

According to the prior art today, audio data in a hearing device for catering for the binaural needs of a user are each time received and processed further by the audio receiver of each hearing aid. In the hearing aid that caters for the right ear, the channel of the right channel is played on the earpiece in the case of stereophonic audio data. In the hearing aid that caters for the left ear, the left channel is accordingly played on the earpiece in the case of stereophonic audio data.

In a first step, the invention identifies that, with such a technique for transmitting in particular stereophonic audio data in the hearing device, energy is used up unnecessarily because the complete stereophonic audio signal is received and processed further in each of the two hearing aids even though only the right or left channel of the audio signal is required each time for output via the respective earpiece.

In a second step, the invention sets out from the consideration that the energy requirement for the insertion of stereophonic audio data into a binaural hearing device can be decreased if the data transmission between the two hearing aids that is implemented in modern binaural hearing devices is used as well, in an intelligent manner, also for transmitting audio data by dint of inductive coupling.

As a way of achieving the stated object, the invention proposes, in a third step, activating only one of the two hearing aids for reception and further processing of audio data (active audio reception state) at a time, while the other of the two hearing aids is deactivated for reception and further processing of stereophonic audio data (inactive audio reception state). In other words, the audio receiver and the further processing of deactivated audio reception state are shut down. Instead, the hearing aid that is in the inactive audio reception state receives audio data from the other hearing aid, which is in the active audio reception state, via the connection that is set up by means of inductive coupling. A time difference between the audio signals for the two ears that arises as a result of the processing and transmission is negligible, since the latencies arising in modern hearing aids are outside human perception. Therefore, modern hearing aids allow realtime processing.

Since only one of the hearing aids at a time is in the active audio reception state while audio data are inserted, the energy requirement for reception and further processing of audio data is initially halved for the hearing device in comparison with parallel bilateral reception. In addition, the data transmission by dint of inductive coupling between the communication units of the two hearing aids, which takes place in the electrodynamic near field, is very energy efficient and, additionally, constantly set up for collation between the hearing aids anyway. Overall, it is therefore possible to improve the energy efficiency for the insertion of audio data for a hearing device for catering for binaural needs by virtue of the audio data being received only unilaterally and being transmitted to the other hearing aid by the inductive signal connection that is set up between the hearing aids.

Fundamentally, the invention is not restricted to the type of the audio data. The energy advantages are also attained for the transmission of mono signals.

Preferably, however, stereophonic audio data are transmitted. Furthermore, the type of the transmission of the audio data is also fundamentally not restricted. In practice, however, wireless transmission of audio data to the hearing device is involved, the wireless transmission being effected particularly by means of digitally coded data. However, the invention is by no means restricted thereto. The hearing aids comprised are particularly hearing aid units that are designed for a user with restricted hearing. The invention is likewise not restricted thereto, however. In this respect, the hearing aids comprised by the invention are also headphones, as are used for a headset or the like, for example.

Preferably, wireless transmission of the audio data is effected by means of a transmission standard for radio networks that are set up locally, such as WLAN. In principle, transmission of the audio data by means of BLUETOOTH is also possible. Since BLUETOOTH is set up by means of what are known as "scatter networks" with variable association of transmission stations, however, this can lead to undesirable signal delays and shadowing phenomena.

Besides the outlined advantage of energy efficient transmission, the invention affords the further advantage of a standard audio signal on both hearing aids, particularly in the case of wireless reception via local radio networks. If the audio signal is received and processed further by both hearing aids independently, then, depending on the whereabouts of the user, undesirable differences in the signal strengths of the audio signals for the two hearing aids can arise. This is avoided with unilateral reception. In this case, the invention allows selection of the receiving or active hearing aid on the basis of the signal strength and/or the signal quality. This is particularly advantageous when the severe attenuation effects in the HF range as a result of the head are considered.

The inductive coupling between the hearing aids involves the use of low frequencies in which the attenuation by the human body is comparatively slight. For transmission by means of inductive coupling between the two hearing aids, a frequency band at 3.2 MHz is used, for example, so that the conditions of the near field are achieved for transmission. By contrast, the frequency band that is used for radio transmission by means of WLAN is at 2.4 GHz. In this frequency range, the human body already results in significant attenuation of the transmission signals.

A further improvement in the energy efficiency for the insertion of stereophonic audio data is achieved if the audio data only from the stereo channel associated with the hearing aid with inactive audio reception are actually provided in the hearing aid with the active audio reception state and only these audio data are transmitted by means of inductive coupling to the hearing aid that is deactivated for audio reception. This further reduces the volume of data to be transmitted by means of inductive coupling in the case of stereophonic audio data. The energy requirement of the hearing device is also decreased further overall as a result.

In a further advantageous embodiment of the invention, the first audio receiver and the second audio receiver are set up for reception and decoding of stereophonic audio data coded using a method for channel coupling. In other words, this makes the hearing aids fit for the reception of compressed stereophonic audio data, which allows a further improvement in energy efficiency to be achieved.

The methods for coding stereophonic audio data by means of channel coupling are methods that take account of the existing redundancy in the two stereo channels. By way of example, the volume of data that needs to be transmitted for stereo signals can be reduced by virtue of the stereophonic audio data being transmitted in the form of an identical signal and a difference signal; the stereo channels match more than they differ. It is also possible for data compression to be achieved by dint of a mid signal and a difference signal being transmitted. It is also possible to make use of properties of the human hearing when compressing stereophonic audio data. By way of example, human hearing evaluates temporal differences for three-dimensional hearing more readily at low frequencies, whereas intensity differences are used for orientation more readily at higher frequencies.

Depending on the respective compression method used, the stereophonic audio data can be reconstructed exactly and completely or with a certain loss of quality at the transmitter end. The methods of compression or coding by means of channel coupling are also known as "joint stereo" methods. The method involving transmission of a center value signal (M) and of a difference signal or side signal (S) is also known as a mid/side method or M/S method.

Data compression for stereophonic audio data reduces the volume of data that needs to be transmitted to the hearing aid or to be received therefrom, which in turn leads to an improvement in energy efficiency. By way of example, a data reduction of up to 25% can be attained with a time-division multiplexing method for transmitting the stereo channels in comparison with separate transmission of the two channels using a joint stereo coding method.

The control device for actuating the two hearing aids is preferably provided as a first control unit in the first hearing aid and as a second control unit in the second hearing aid, the first and the second control units communicating by dint of transmission of data by means of the inductive coupling that is set up between the communication devices. This does not necessarily require master/slave operation. In an alternative configuration, the control device is arranged externally and undertakes the control particularly of both hearing aids, for example via an appropriately set-up radio link. In particular, an external control device is arranged in an audio transmitter that provides the audio data.

Appropriate control swaps the audio reception states within an operating period on the basis of a parameter that characterizes a signal strength of the audio signal and that is based on one hearing aid at a time. In this case, particular reference is made to a change of position of the user, so that the existing signal strength is taken as a basis for recommending changing the hearing aid in the inactive audio reception state to the active audio reception state and at the same time deactivating the other hearing aid for audio reception. On the other hand, repeated swapping of roles as a hearing aid that is active or inactive for audio reception provides opportunities to extend the overall life of the binaural hearing device. By way of example, appropriate swapping of roles between the two hearing aids is used to achieve uniform discharge or loading of the batteries if the battery that has a lesser energy content each time adopts the inactive role for audio reception more frequently. This particularly also takes account of a difference in the state of charge of freshly inserted batteries or of an increased unilateral loading of a battery, the latter being a consequence of a differently set gain in the hearing aids owing to different hearing in the two ears, for example. Regardless of such considerations, the roles of the hearing aids for audio reception are preferably periodically swapped for the purposes of uniform loading of the two hearing aids, to which end the control device is set up as appropriate.

Accordingly, the control device is set up to swap the audio reception states of the hearing aids on the basis of a parameter that characterizes a signal strength of the audio signal and that is based on one hearing aid at a time. Capture of such a parameter allows the present state existing for one hearing aid at a time to be taken into account and the audio reception states of the hearing aids to be swapped as appropriate for the purposes of an extended life of the overall system.

In addition to swapping of the audio reception states of the hearing aids, there is preferably provision, particularly at a lower level, for the hearing aid whose battery has a greater energy content or that is under less load in respect of power draw to be switched to the active audio reception state. In other words, the control device is additionally set up to swap the audio reception states of the hearing aids on the basis of a parameter that characterizes a battery state or a load state and that is based on one hearing aid at a time.

In this context, the term battery is understood to mean either a rechargeable battery, that is to say a storage battery, or a battery that is provided for single use.

Expediently, a control device is provided that is set up to ascertain a respective present energy content, that is to say particularly a present state of charge, of the first and second batteries at prescribable intervals of time, to compare the ascertained energy contents with one another and to switch the respective hearing aid whose battery currently has a lesser energy content to the inactive audio reception state. Here and subsequently, the term prescribable interval of time is understood to mean that the interval of time is either firmly prescribed or variably adjustable to a value that is then prescribed.

The control device is preferably additionally set up to ascertain a respective wear and/or degree of aging of the first and second batteries at prescribable intervals of time, to compare the ascertained degrees of wear and/or aging with one another and to switch the respective hearing aid whose battery has a greater degree of wear and/or aging to the inactive audio reception state. In particular, the wear and/or degree of aging of a battery is established using the "state of health" or using the residual capacity, that is to say the maximum possible charging capacity.

In one development, the control device is preferably also set up to detect a respective active power draw from the first and second batteries at prescribable intervals of time, to compare the detected power draws with one another and to switch the respective hearing aid whose battery currently has a higher power draw to the inactive audio reception state.

The aforementioned switching strategies result in extension of the operating time and life of the overall system. In particular, imbalances in the two hearing aids in respect of power draw, initial states of charge of the batteries, states of aging or wear of the batteries, e.g. age or number of charging and discharge cycles, or battery quality are reduced in this case.

Preferably at a higher level, the control device is expediently set up to detect the respective signal strengths of the audio data received in the first hearing aid and in the second hearing aid at selectable intervals of time, to compare the detected signal strengths with one another and to switch the respective hearing aid whose signal strength is currently lower to the inactive audio reception state. Conversely, this naturally involves the hearing aid whose detected signal strength is stronger being switched to the active audio reception state. This improves the signal quality of the inserted audio data for the user.

In a further preferred configuration, the control device is set up to identify an audio signal by switching one of the hearing aids at a time to the active audio reception state and otherwise both hearing aids each to the inactive audio reception state at prescribable intervals of time. In other words, only one of the hearing aids at a time is active for identifying an audio signal. When an audio signal is identified, it is received and processed further by means of the hearing aid switched to the active audio reception mode and is transmitted to the other hearing aid by means of inductive coupling. Since the audio data are not received by means of both hearing aids, it is not necessary for both hearing aids regularly to be switched to an active operating state for detecting audio signals. This also improves energy efficiency. For the purpose of identifying an audio signal, only one of the two hearing aids at a time is regularly activated.

Expediently, the hearing device additionally comprises an audio transmitter that is set up for wireless transmission of in particular stereophonic audio data. In particular, the audio transmitter is in this case set up to code stereophonic audio data using a method for channel coupling. By way of example, such an audio transmitter is a smartphone that provides the required functions by implementing an appropriate piece of software ("app"). Alternatively, the audio transmitter is in the form of part of an audio source, such as a PC, a stereo system or a TV receiver, or in the form of part of an audio transceiver. In this case, the audio transceiver is a link between an audio source and the hearing device. The audio transceiver receives the audio data from the relevant audio source and converts them into corresponding signals that comprise stereo data coded particularly using a method for channel coupling.

The variant embodiments of the invention that are described above relate both to the hearing device and to a method for operating such a hearing device. In this case, the cited advantages can be transferred mutatis mutandis without any difficulty. Where method steps are described as such, they are implemented in the hearing device by a control device that is set up to perform the relevant method steps with appropriate actuation of the components of the hearing device or of the hearing aids.

BRIEF DESCRIPTION OF THE DRAWING

An exemplary embodiment of the invention is explained in more detail with reference to a drawing in which The FIGURE shows a hearing device for catering for the binaural needs of a user, which hearing device is set up to insert stereophonic audio data.

DESCRIPTION OF THE INVENTION

The FIGURE shows a hearing device 1 for catering for the binaural needs of a user 2 by means of a first hearing aid 4 for catering for the first, right ear 5 and by means of a second hearing aid 6 for catering for the second, left ear 7. The hearing device 1 shown is set up to insert in particular stereophonic audio data 8 by means of both hearing aids 4,6. To this end, the audio data 8 are transmitted to the hearing aids 4, 6 by means of radio, for example by means of WLAN, to which end an appropriate audio transmitter 9 is provided. By way of example, the audio transmitter 9 is a smartphone or an audio transceiver that is connected to an audio source 30 by wire or wirelessly. By way of example, the audio source 30 is a PC, a TV receiver, a broadcast radio receiver or a stereo system.

The first hearing aid 4 comprises a first audio receiver 10 for reception and further processing of audio data, a first communication unit 11, a first earphone 12 and a first control unit 13. For the purpose of supplying power, a rechargeable first battery 14 is implemented.

Accordingly, the second hearing aid 6 comprises a second audio receiver for reception of audio data 8, a second communication unit 21, a second earphone 22 and a second control unit 23. For the purpose of supplying power, a second rechargeable battery 24 is implemented.

The first communication unit 11 and the second communication unit 21 are designed for reciprocal data transmission by dint of inductive coupling. During the operation of the hearing device 1, this data transmission is used for constantly performing collation of data between the first hearing aid 4 and the second hearing aid 6 in respect of optimum catering for the binaural needs of the user 2.

To insert preferably stereophonic audio data 8, only one of the hearing aids 4, 6 at a time is put into an active audio reception state. The other of the hearing aids 4, 6 is then in an inactive audio reception state each time. In the present case, the right hearing aid 4 is switched to the active audio reception state. The left hearing aid 6 is switched to the inactive audio reception state. The stereophonic audio data 8 are received exclusively from the hearing aid 4 by radio and processed further. The stereophonic audio data 8 contain a right stereo channel R and a left stereo channel L.

The first hearing aid 4, when prompted by the first control unit 13, processes the received stereophonic audio data 8 further. In particular, the right stereo channel R is extracted and transferred to the first earphone 12. At the same time, the received audio data 8 are transmitted from the first earphone 4, which is in the active audio reception state, to the second communication unit 21 of the second hearing aid 6 by means of inductive coupling via the first communication unit 11. Said second communication unit extracts the left stereo channel L from the received audio data and transfers it to the second earphone 22.

The control units 13, 23 of the two hearing aids 4, 6 likewise communicate by means of the inductive coupling between the communication units 11 and 21. In particular, the roles assigned to the hearing aids 4, 6 for an active or inactive audio reception state are swapped at regular intervals by dint of appropriate actuation by means of the first and second control units 13, 23. This achieves uniform loading of the batteries 14 and 24. Preferably, this involves the control units 13, 23 being used to ascertain the respective battery status in the associated hearing aid 4, 6 and, each time, that hearing aid 4, 6 whose battery 14, 24 still has a greater energy content being switched to the active audio reception state. At a higher level, regular checking of the signal strength of the received audio data 8 switches that hearing aid 4, 6 in which audio data 8 are received at a higher signal intensity to the active audio reception state.

If no further stereophonic audio data 8 are received over a prescribed period, the control units 13, 23 are used to put both hearing aids into the inactive audio reception state. At regular intervals of time, one of the hearing aids 4, 6 is then put into the active audio reception state and a check is performed to determine the extent to which audio signals 8 are available for insertion. If audio signals 8 are identified, they are inserted into the hearing device 1 by means of the activated hearing aid 4, 6.

The method described and presented allows a high level of energy efficiency for the insertion of stereophonic audio data 8, since the latter are received and processed further merely unilaterally. The forwarding of the audio data 8 to the other hearing aid 4 or 6 takes place in an energy efficient manner by means of inductive coupling between the communication units 11, 21.

A further improvement in energy efficiency is achieved by virtue of the audio transmitter 9 being designed to code and send stereophonic audio data 8 coded using a method for channel coupling. This allows data compression and hence a data rate that is decreased for transmission of the audio data 8. In addition, the energy efficiency of the method is improved by dint of the inductive coupling between the two communication units 11, 21 being used, in one envisaged variant embodiment, to transmit just that stereo channel (in the present case the left stereo channel L) that is needed for the respective hearing aid 4, 6 that is inactive for audio reception.

The invention claimed is:

1. A hearing device, comprising:

a first hearing aid for a first ear of a user, said first hearing aid having a first communication unit, a first audio receiver and a first earphone;

a second hearing aid for a second ear of the user, said second hearing aid having a second communication unit, a second audio receiver and a second earphone;

said first communication unit and said second communication unit being configured for reciprocal data transmission by dint of inductive coupling, and said first and second audio receivers being configured for receiving and processing stereophonic audio data;

a control device configured for controlling said first hearing aid and said second hearing aid, said control device being configured to switch one of said first and second hearing aids to an inactive audio reception state and switching the other of said first and second hearing aids to an active audio reception state, to swap the audio reception states of said first and second hearing aids within an operating period on a basis of a parameter that characterizes a signal strength of the audio signal and that is based on one of said first and second hearing aids at a time, and to cause the respective said hearing aid with the active audio reception state to transmit audio data to the respective said hearing aid with the inactive audio reception state by dint of inductive coupling by way of said communication units;

wherein when said first hearing aid is switched to the inactive audio reception state by said control device, said first audio receiver is deactivated or shut down and further processing of external audio data is deactivated or shut down in said first hearing aid; and wherein when said second hearing aid is switched to the inactive audio reception state by said control device, said second audio receiver is deactivated or shut down and further processing of external audio data is deactivated or shut down in said second hearing aid.

2. The hearing device according to claim 1, wherein said control device is configured to actuate said hearing aid with the active audio reception state to transmit audio data only from a stereo channel associated with said hearing aid with inactive audio reception.

3. The hearing device according to claim 1, wherein said first audio receiver and said second audio receiver are configured for reception and decoding of stereophonic audio data coded by dint of a channel coupling process.

4. The hearing device according to claim 1, wherein said control device comprises a first control unit in said first hearing aid and a second control unit in said second hearing aid, and said first and second control units are configured to communicate by dint of transmission of data between the communication devices.

5. The hearing device according to claim 1, wherein said control device is configured to periodically swap the audio reception states of said hearing aids within an operating period.

6. The hearing device according to claim 1, wherein said control device is configured to detect respective signal strengths of audio data received in said first hearing aid and in said second hearing aid at prescribable intervals of time, to compare the detected signal strengths with one another and to switch the respective said hearing aid with a currently lower signal strength to the inactive audio reception state.

7. The hearing device according to claim 1, wherein said control device is configured to identify an audio signal by switching one of said first and second hearing aids at a time to the active audio reception state and otherwise both first and second hearing aids each to the inactive audio reception state at prescribable intervals of time.

8. The hearing device according to claim 1, which further comprises an audio transmitter configured for wireless transmission of stereophonic audio data.

9. The hearing device according to claim 1, which further comprises an audio transmitter configured for wireless transmission of stereophonic audio data coded by way of a channel coupling process.

10. A method for operating a hearing device, the hearing device having:

a first hearing aid for the first ear and a second hearing aid for the second ear of a user, the first hearing aid having a first communication unit, a first audio receiver and a first earphone, the second hearing aid having a second communication unit, a second audio receiver and a second earphone, and wherein the first communication unit and the second communication unit are designed for reciprocal data transmission by dint of inductive coupling, and a control device configured to control the first hearing aid and the second hearing aid;

the method comprising:

in an active audio reception state of one of the first and second hearing aids, receiving and further processing with the associated audio receiver audio data, while maintaining the other one of the first and second hearing aids in an inactive audio reception state in which the audio receiver of the other one of the first and second hearing aids is deactivated or shut down and further processing of external audio data is deactivated or shut down in the other one of the first and second hearing aids;

swapping the audio reception states of the first and second hearing aids within an operating period on a basis of a parameter that characterizes a signal strength of the audio signal and that is based on one hearing aid at a time; and using the hearing aid in the active audio reception state to transmit audio data to the hearing aid in the inactive audio reception state by dint of inductive coupling through the first and second communication units.

11. The method according to claim 10, which comprises using the hearing aid in the active audio reception state to transmit audio data only from a stereo channel associated with the hearing aid in the inactive operating state.

12. The method according to claim 10, which comprises receiving and decoding with the audio receiver of the respective hearing aid in the active audio reception state stereophonic audio data coded using a process for channel coupling.

13. The method according to claim 10, which comprises swapping the audio reception states of the hearing aids within an operating period.

14. The method according to claim 13, which comprises periodically swapping the audio reception states of the hearing aids within an operating period.

15. The method according to claim 10, which comprises detecting respective signal strengths of the audio data received in the first hearing aid and in the second hearing aid at prescribable intervals of time, comparing the detected signal strengths with one another and switching the respective hearing aid whose signal strength is currently lower to the inactive audio reception state.

16. The method according to claim 10, which comprises identifying an audio signal by switching one of the hearing aids at a time to the active audio reception state and otherwise both hearing aids each to the inactive audio reception state at prescribable intervals of time.

17. The method according to claim 10, which comprises wirelessly receiving the audio data from an audio transmitter.

18. The method according to claim 17, wherein the audio data are stereophonic audio data coded with a channel coupling process.

* * * * *